United States Patent [19]

Dechantsreiter

[11] 4,375,936

[45] Mar. 8, 1983

[54] STACKER CRANE FOR MOVEMENT OF COILS

[75] Inventor: Max J. Dechantsreiter, Milwaukee, Wis.

[73] Assignee: Harnischfeger Corporation, West Milwaukee, Wis.

[21] Appl. No.: 179,097

[22] Filed: Aug. 18, 1980

[51] Int. Cl.[3] ..... B66C 1/42

[52] U.S. Cl. ..... 414/626; 212/129; 294/103 CG; 414/684; 414/783; 414/910; 414/911

[58] Field of Search ..... 414/626, 684, 783, 910, 414/911, 629; 212/127, 129; 294/86 LS, 102 R, 103 R, 103 CG

[56] References Cited

U.S. PATENT DOCUMENTS

| | | | |
|---|---|---|---|
| 2,945,609 | 7/1960 | Benes et al. | 294/103 CG X |
| 2,999,716 | 9/1961 | Elberty | 294/86 LS |
| 3,104,016 | 9/1963 | Harry | 414/626 X |
| 3,421,635 | 1/1969 | Bunger | 212/129 X |

FOREIGN PATENT DOCUMENTS

| | | | |
|---|---|---|---|
| 1221411 | 7/1966 | Fed. Rep. of Germany | 294/103 CG |

*Primary Examiner*—Andres Kashnikow

*Attorney, Agent, or Firm*—James E. Nilles

[57] ABSTRACT

A crane for lifting and transporting a load such as a heavy metal coil. An overhead winch lifts and lowers a load carriage and the load attached thereto, and a powered wheeled trolley moves the load horizontally above a floor. Attached to the carriage is a clamp, which engages the coil through its center aperture and its periphery. The clamp has two jaws, one movable with respect to the other, the movable jaw also having a movable gripping surface that moves on an inclined surface of the movable jaw towards the fixed jar to ensure a tight wedging engagement of the load. The jaws and gripping surfaces provide a nonpowered, mechanically firm grip on the load once it has been engaged by the jaws. The coil may be lifted with the jaws when its center aperture is vertically or horizontally disposed, and the load may be placed for storage in either position as well.

6 Claims, 13 Drawing Figures

STACKER CRANE FOR MOVEMENT OF COILS

BACKGROUND OF THE INVENTION

1. Field of Use

This invention relates generally to material handling devices, and more particularly to traveling cranes supported by overhead rails and having a vertical, rigid telescoping mast on which a load carriage is vertically movable and capable of lifting and transporting a cylindrical load such as a metal coil. These devices are sometimes referred to as stacker cranes.

2. Description of Prior Art

Coil lifting and transporting devices of the type to which the present invention relates have overcome some of the problems associated with the art, but each has been deficient in at least one important respect.

Several devices have provided means for engaging a coil that are somewhat dangerous. Some prior art lifters engage a coil in its center aperture and also along its periphery with a pair of jaws. However, some of these lifters, such as those described in U.S. Pat. No. 3,104,016, issued to Harry, on Sept. 17, 1963, have relied upon hydraulic cylinders to maintain the jaws in tight wedging engagement with the coil. Malfunction of a hydraulic cylinder or loss of hydraulic fluid while the Harry lifter is moving an elevated load would create a potentially serious hazard. Other lifters, such as those described in U.S. Pat. No. 2,999,716, issued to Elberty, on Sept. 12, 1961 have the coil-engaging apparatus suspended from a cable, with a hook attaching the cable to the apparatus at a horizontally-disposed pin therein. The pin and hook create a pivot point about which the suspended apparatus and coil may swing in an uncontrollable fashion.

Other devices, including Elberty, have used a pad sliding on an inclined surface of a jaw to more tightly engage a coil between a pair of jaws. Such devices, however, require two sliding pads, one on each jaw, to engage a coil for lifting and further show that both the jaw engaging the coil at its center aperture and the jaw engaging the coil along its periphery be movable with respect to the gear quadrant which rotates the coil through a ninety degree arc. These features unnecessarily complicate such devices and add to their fabrication expense and potential for maintenance.

Other coil handling devices are lacking features which would give them broader utility. Among these are devices, such as that described in U.S. Pat. No. 2,630,931, issued to Douglas on Mar. 10, 1953, which engage the coil with magnets, disenabling them from handling aluminum coil. Still others, such as that described in U.S. Pat. No. 3,734,328, issued to Dalglish, on May 22, 1973, are not able to transport coils over obstructions on the floor, as there is no ground clearance between the bottoms of the fully raised devices or the coils carried thereby and the ground.

SUMMARY OF THE INVENTION

The invention provides an overhead traveling crane comprising a wheeled trolley mounted for travel above a floor, with a rigid mast assembly mounted on and below the trolley. The mast assembly includes two, spaced-apart parallel masts terminating in a free end above the floor, each mast having a vertical guideway along its inner side such that the guideways face each other. A load carriage, whose lower end carries clamping means is moved vertically between the guideways by power winch means connecting the trolley to the carriage. The clamping means comprise a gear segment assembly pivotally mounted on a horizontal axis on the carriage including a gear segment with teeth on its arcuate periphery and a fixed jaw member, a ram member normal to the fixed jaw member, a movable jaw slidably mounted on the ram, and power means for sliding the jaw on the ram. Additional power means are carried by the load carriage and include a driven pinion for meshing with the teeth on the gear segment, whereby the clamping means are rotated about the gear segment assembly's horizontal axis for swinging the load carried by the clamping means about an arcuate path of about ninety degrees.

Accordingly, an object of this invention is a coil handling device which can carry a coil of any material over ground obstructions in that coil's path of movement. A further object of this invention is a coil-handling device which does not depend upon powered or hydraulically-held jaws to retain the coil therebetween after the jaws have been once tightened on the coil. Another object of this invention is a coil handling device that prevents swinging of a lifted coil in an uncontrolled fashion, and which has only one movable gripping jaw and one non-fixed gripping surface. Other objects of the invention will appear hereinafter.

DETAILED DESCRIPTION OF PREFERRED EMBODIMENT OF THE INVENTION

TROLLEY FRAME

Figure 2:
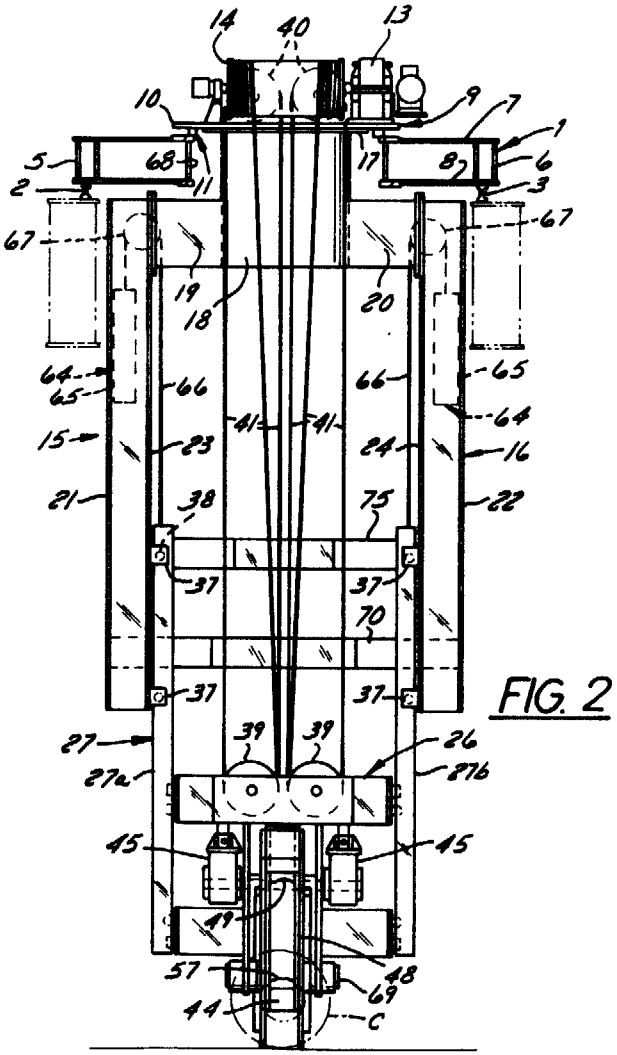
FIG. 2 is a front elevational view of the crane shown in FIG. 1, in the "down" position.

An overhead trolley 1 has a series of wheels 4 which are guided by rails 2 and 3, the wheels being suitably journalled in the two parallel frame members 5 and 6. A large rectangular steel plate 7 is welded across the upper sides of members 5 and 6 and rectangular steel plate 8 is also welded to members 5 and 6, all forming a rigid trolley frame. A turntable 9 is carried on the trolley frame for rotation about a central, vertically disposed axis. This turntable 9 carries a downwardly extending rigid mast assembly 15 which rotates together with the turntable 9 as a single unit above this vertical axis.

TURNTABLE

The turntable 9 includes a large, horizontal, circular steel plate 10 which is rotatably supported by the large, anti-friction bearing ring assembly 11 located on the top of rectangular plate 7, and rotated by rotation drive assembly 62. Power winch means carried by the trolley 1 and located on top of the turntable comprises the conventional electric motor 12 connected by the drive reduction unit 13 to the cable drum 14.

MAST ASSEMBLY

Figure 12:
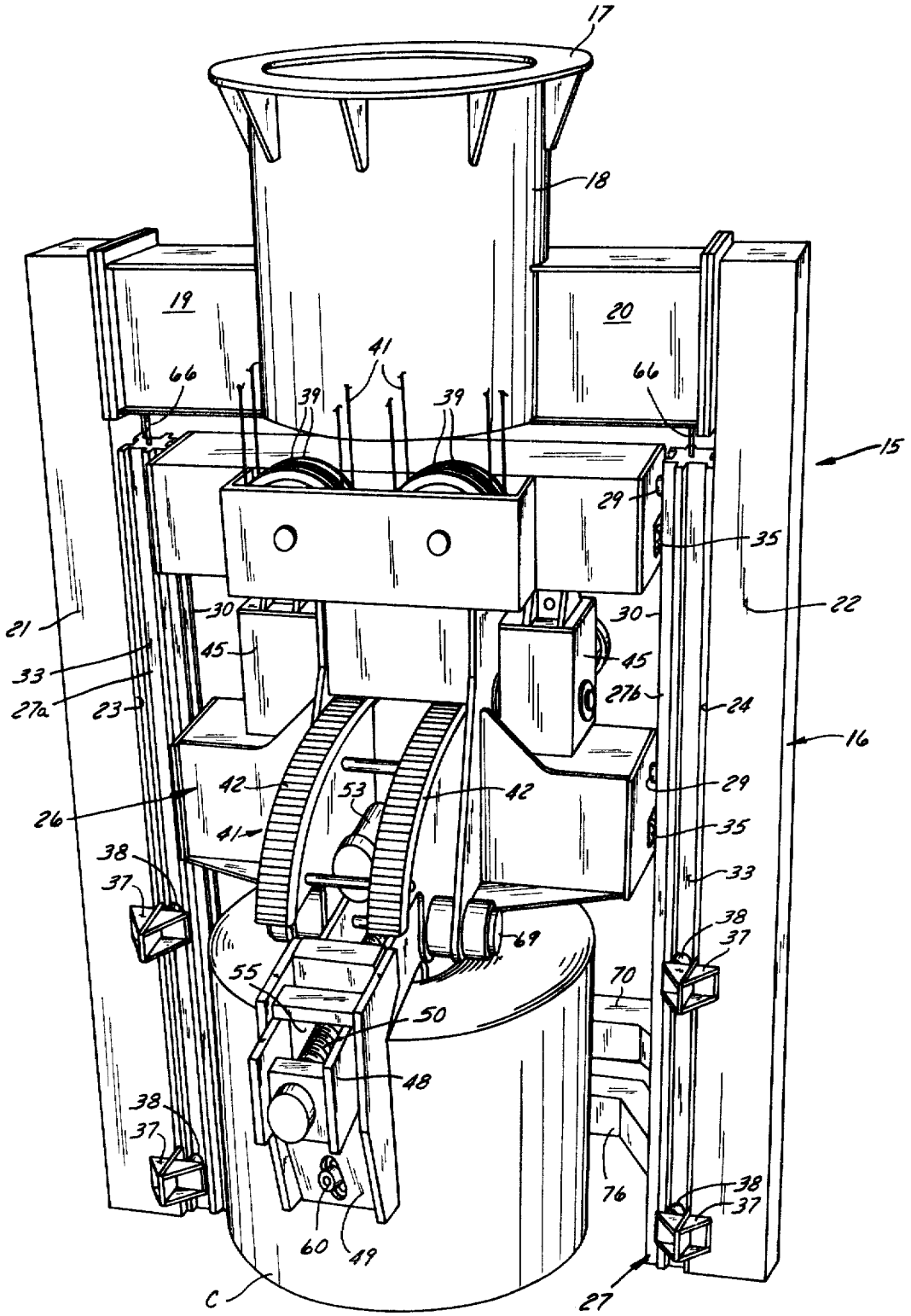
FIG. 12 is a perspective view of the apparatus described herein, less the wheeled trolley and components mounted thereon.

The rigid mast assembly 15 is fixed to the underside of the turntable and extends downwardly therefrom. The mast assembly 15 includes rigid mast 16, which comprises rigid vertically disposed cylindrical frame member 18 (FIG. 12), welded to an upper plate 17, which is in turn rigidly secured to turntable plate 10 by welding or bolt means. Horizontal axis arms 19 and 20 are each secured at one end to member 18. To the other ends of each of arms 19 and 20 are attached downwardly extending, box-beamed, spaced-apart parallel masts or mast members 21 and 22, each terminating in a free end above the floor and rigidly maintained in a parallel relation by U-shaped insert brace 70 attached to masts 21 and 22 adjacent their free ends. The inner sides of the parallel masts 21 and 22 comprise vertically extending guideways 23 and 24 facing each other. Mast assembly 15 further includes a shorter, intermediate mast 27 which slides up and down the guideways 23 and 24 of rigid mast 16, and also includes carriage 26, which can be vertically positioned relative to the intermediate mast 27. Intermediate mast 27 permits axial stability of load carriage 26 when the latter is vertically positioned lower than parallel masts 21 and 22, as shown in FIG. 2.

Intermediate mast 27 comprises a pair of parallel masts or mast members **27*a* and 27*b*, each mast having a plurality of tracks (FIG. 12) to which rollers attached to load carriage 26 and parallel masts 21 and 22 are engaged. The parallelism of masts 27*a* and 27*b* is assured by U-shaped upper beam brace 75 attached to masts 27*a* and 27*b* adjacent their upper ends and by U-shaped lower beam brace 76 attached to masts 27*a* and 27*b* adjacent their lower ends. Each mast includes an inside face 30, an inside track 31, front-facing track 33, rear-facing track 34, and an outside track 32. Two guide rollers 29 (FIG. 6) are attached by bolt means along horizontal axes to each of the outwardly facing opposite sides of load carriage 26, which guide rollers 29 are held captive and guided in their vertical movement by the track 31 adjacent the rollers. Two other guide rollers 35 are also mounted by bolt means to each the outwardly-facing opposite sides of load carriage 26, but are disposed on horizontal axes ninety degrees to those of rollers 29, and guided on face 30** of the intermediate mast.

Means for guiding the vertical movement of intermediate mast 27 relative to parallel masts 21 and 22 are also provided. Four brackets 37 are weldably attached to parallel mast 22 at guideway 24, the two brackets visible in FIG. 12 in a front-facing position and two brackets visible in FIG. 4 in a rear-facing position. A guide roller 38 is attached by bolt means to each of the four brackets 37 on the same horizontal axis as guide rollers 35. The guide rollers 38 attached to front-facing brackets 37 are held captive and guided in their vertical movement by the track 33, and the guide rollers 38 attached to rear-facing brackets 37 are held captive and guided in their vertical movement by the track 34. An identical intermediate mast guiding means is provided at parallel mast 21 and guideway 23.

Figure 1:
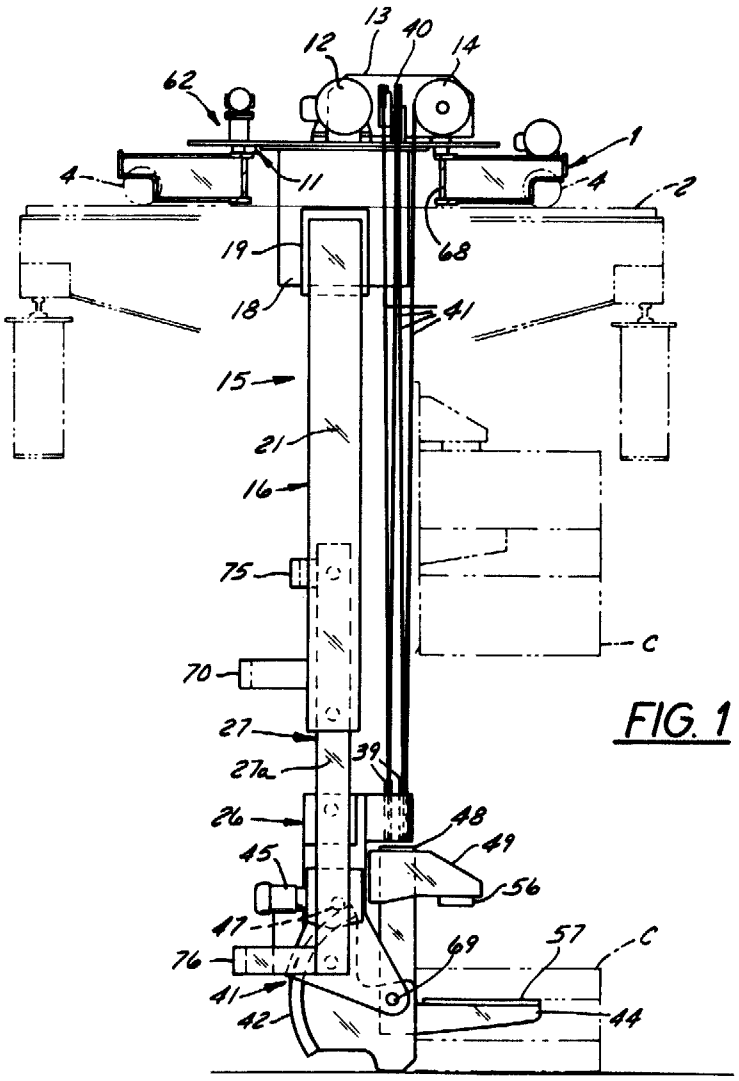
FIG. 1 is a side elevational view of a stacker crane coil lifting device in the fully extended or "down" position in accordance with the present invention, certain parts being shown in phantom to demonstrate the position of components in the fully retracted or "up" position.
Figure 3:
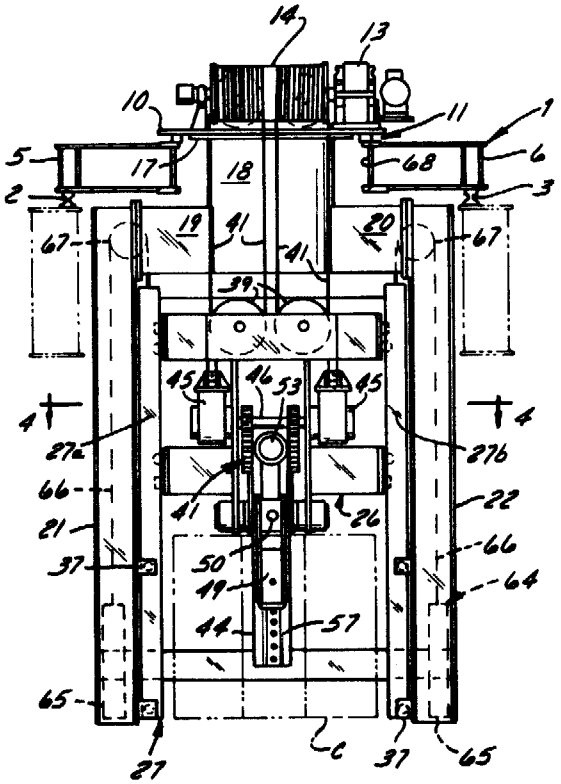
FIG. 3 is a front elevational view of the crane shown in FIG. 2 in the "up" position.

The intermediate mast 27 is shown in FIG. 3 with the crane in an overhead position engaging a coil load. The guide rollers 29 at the lower end of carriage 26, upon reaching the bottom of track 31 on intermediate mast 27, engage stops preventing carriage 26 from becoming disengaged from intermediate mast 27 and causing the lowering of intermediate mast 27 therewith. From the crane's lowermost position as shown in FIGS. 1 and 2, retraction of the cables 41 by the winch means to raise carriage 26 (FIG. 3) results in a raising of intermediate mast 27 at the same rate by counterweight means 64. Counterweight means 64 comprise a pair of counterweights 65 within the beams of parallel masts 21 and 22 connected to the upper end of intermediate mast 27 by a pair of mast cables 66 reeved over a pair of sheaves 67 within the beams of parallel masts 21 and 22 and the beams of horizontal arms 19 and 20, respectively.

POWER LIFT

A cable lifting system is provided between the rigid mast 16 and the load carriage 26, and comprises a plurality of sheaves 39 mounted on the load carriage 26, a plurality of sheaves 40 mounted on the turntable 9, and cables 41 reeved between sheaves 39 and 40 in the known manner and engaged by cable drum 14 to effect lifting or lowering of load carriage 26 by electric motor 12 through drive reduction unit 13 rotating cable drum 14. The cables 41 for vertically moving carriage 26 and extending from turntable sheaves 40 and cable drum 14 pass through turntable plate 10 and through the center opening 68 of overhead trolley 1.

CLAMPING MEANS

Figure 5:
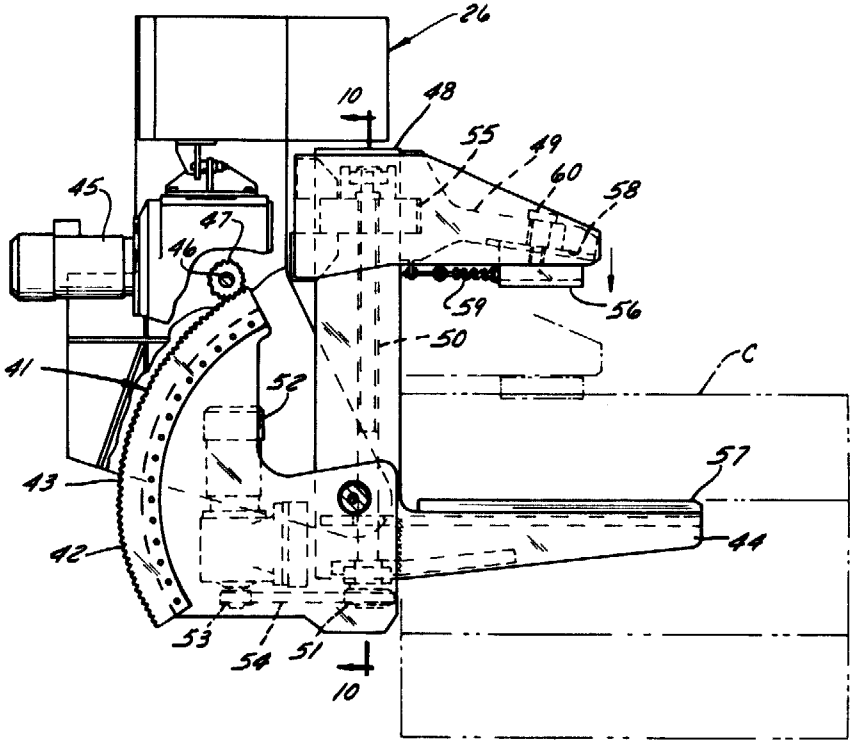
FIG. 5 is an enlarged, fragmentary side elevational view of the clamping means portion of the crane shown in FIG. 1, engaging a coil with a horizontally-disposed axis.
Figure 9:
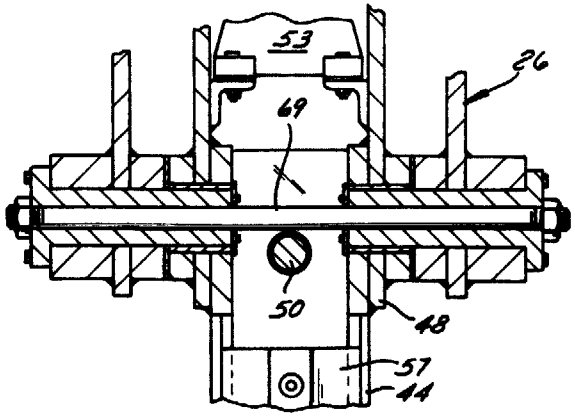
FIG. 9 is a sectional view taken along line 9—9 of FIG. 6.
Figure 7:
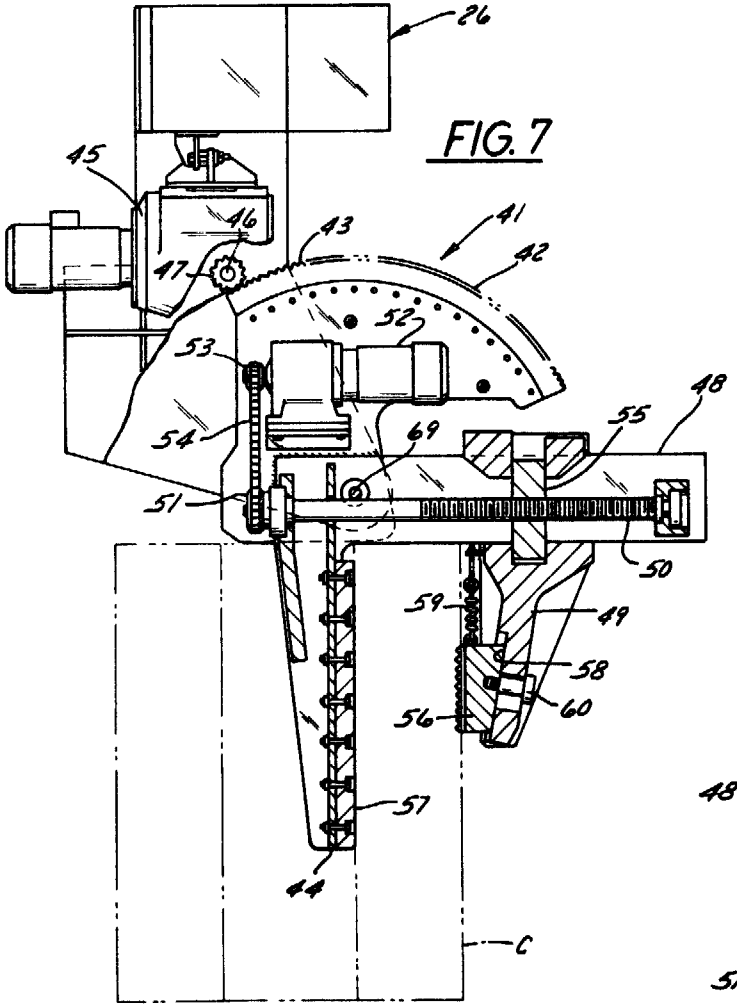
FIG. 7 is a view similar to FIG. 5, with certain portions in section for the sake of clarity of the clamping means portion of the crane shown in FIG. 1, engaging a coil with a vertically-disposed axis.

The lower end of the load carriage 26 includes clamping means for lifting a load, such as a metal coil C. The clamping means comprise a gear assembly 41 with a pair of gear segments 42, each having a series of teeth 43 on its arcuate periphery sufficient to enable rotation of each gear segment 42 through an angle of approximately ninety degrees about an axis formed by pivot bolt 69 (FIGS. 5, 7, and 9). Fixed jaw member 44 is between and rigidly and fixedly attached to, gear segments 42 for rotation therewith. Power means for rotation of the gear segment are attached to the load carriage 26 and include a pair of synchronous gear-motors 45, each connected to the opposite ends of a shaft 46 therebetween which rotates two pinions 47 attached thereto, each engaging one of the two gear segments 42

Figure 4:
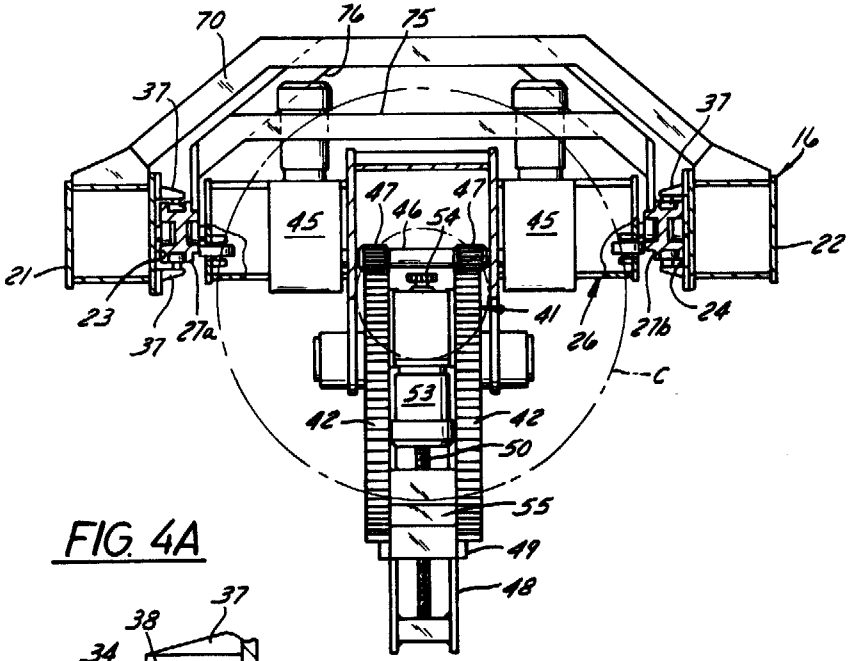
FIG. 4 is a cross sectional view of the crane shown in FIG. 3 taken along line 4—4 of FIG. 3.
Figure 4A:
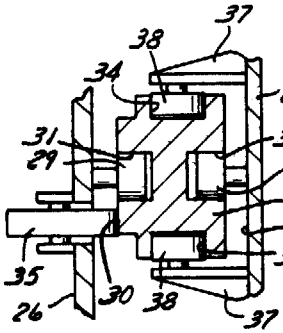
FIG. 4A is a fragmentary, enlarged view of a portion of the guide roller arrangement of the FIG. 4 showing.
Figure 8:
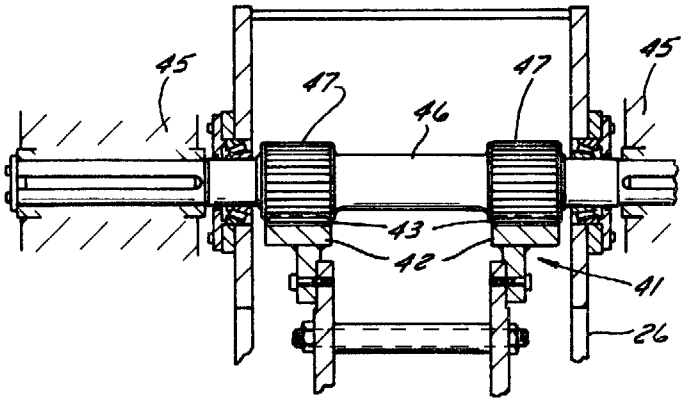
FIG. 8 is a sectional view taken along line 8—8 of FIG. 6.

(FIGS. 4 and 8). A ram member 48 is weldably attached to and between gear segments 42 for rotation therewith and extends generally normal to fixed jaw member 44. A movable jaw 49 is slidably mounted on the ram member 48 for movement toward and away from fixed jaw member 44, by which movement the fixed jaw member 44 and movable jaw 49 can come together to grip a load between them.

Figure 10:
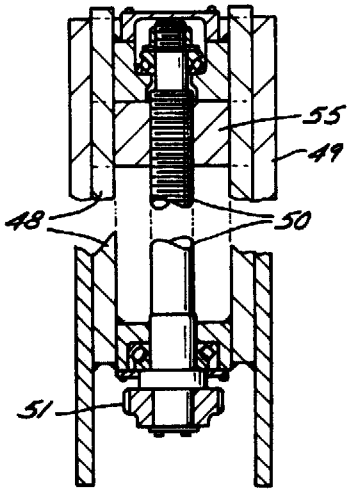
FIG. 10 is a sectional view taken along line 10—10 of FIG. 5.

Means for slidably moving movable jaw 49 along ram member 48 are shown in FIG. 10 and include an elongated, threaded shaft, or clamp drive screw 50, rotatably mounted within ram member 48, supported at both ends with bearing means and fixedly attached at one end to a driven sprocket 51. Electric screw gearmotor 52 (FIGS. 5 and 9), rotatable in a clockwise or counterclockwise direction, rotates fixedly-attached drive sprocket 53, and also roller chain 54, which chain engages drive sprocket 53 and driven sprocket 51, whereby clamp drive screw 50 is also rotated. A clamp nut 55 is an internally threaded member that is fixedly attached to movable jaw 49, preventing the nut's rotation, and is threadably engaged to clamp drive screw 50 for movement therealong as the latter rotates. As clamp nut 55 moves along the rotating clamp drive screw 50, movable jaw 49 to which the clamp nut 55 is fixedly attached, moves along the ram member in the same direction. Whether the movable jaw 49 moves toward or away from the fixed jaw member 44 depends upon the direction the clamp drive screw 50, and thus the screw gearmotor 52, is moving.

Figure 6:
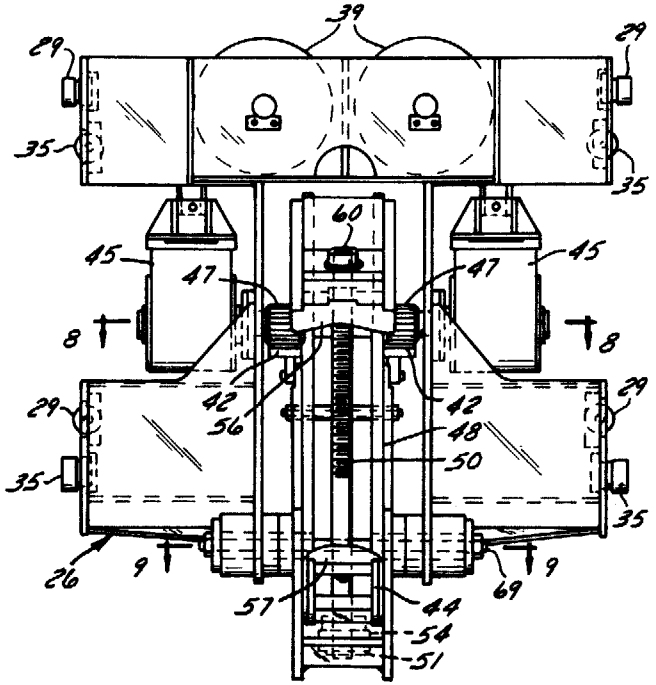
FIG. 6 is a front elevational view of the load carriage of the crane shown in FIG. 2.
Figure 11:
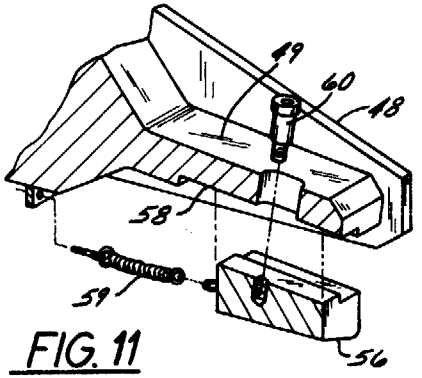
FIG. 11 is an isometric view in cross section of a portion of the movable jaw shown in FIG. 5 and the gripping pad mounted thereon.

The movable jaw 49 has a gripping surface unlike that of the fixed jaw member 44. The latter has a fixed, convex gripping surface 57 to conform to the concave inner coil surface which it engages whereas the former has a pad 56 with an angled face and which slides on surface 58 at an inclined angle to the fixed gripping surface 57. The pad face is angled approximately as shown in FIG. 6 and can thereby handle coils of various diameters while distributing the load over a broader pad area than would be possible with a flat, non-angled pad. Such an even, two-point distribution is desirable in that it minimizes damage to the outermost layers in handling. The incline on surface 58 is such that when a load is placed between jaw members 44 and 49, the pad 56 sliding in the direction of the load's pull is urged toward the fixed gripping surface 57. A shoulder bolt 60 threadably engages pad 56 and slides within a slot in movable jaw 49 (FIG. 11). The travel of pad 56 along inclined surface 58 is thus limited to the travel of shoulder bolt 60 in slot 61. For example, in FIG. 7 a metal coil is shown in phantom lines as the clamping means would engage it. Upward movement of the coil is accomplished by lifting the load carriage and gear assembly attached thereto with the cable lifting system described hereinabove. Such upward urging would be met by downward resistance of the gravity-pulled coil, which resistance would pull pad 56 downward along inclined surface 58. Clearly such downward movement of pad 56 would shift it toward fixed gripping surface 57, causing a tight, wedging engagement of the coil C between fixed jaw member 44 and movable jaw 49. Spring means 59 attached at one end to pad 56 and at the other end to movable jaw 49 retracts pad 56 along inclined surface 58 to its upper position in FIG. 7 and where the pad 56 is most distant from fixed gripping surface 57 for a given spacing between movable jaw 49 and fixed jaw member 44 when the coil or other load is removed from between the gripping surfaces 56 and 57.

RECAPITULATION

The invention provides means for lifting and transport of a load, such as a metal coil. The pickup of the coil may be done with its axis in a horizontal or vertical position, and the coil may be rotated about ninety degrees from the position in which the coil is engaged by the vertically downward pointing jaws, and released in any of those positions. The invention permits lifting of any metal, as it relies on non-magnetic means to grip the load. The load can be raised vertically and then moved horizontally, thereby clearing obstructions in its path below. Once raised, the load is positively engaged and no hydraulic or electric power is required to maintain a grip thereon, eliminating the possibility of dropping the load from an overhead position. The lifting load is spread over a convex, stationary gripping jaw and an angled, movable gripping jaw pad, minimizing deformation of the material lifted thereby and thus minimizing material ruined in transport. The clamping means are suspended from the crane at more than one point, preventing the swinging of the coil or other load about a pivot point in an uncontrollable fashion. The jaws used to grip the load are simple and relatively inexpensive to construct, requiring only one moving jaw and only one movable gripping surface, placed in this embodiment on the movable jaw.

What I claim is:

1. An overhead travelling crane comprising a wheeled trolley mounted for travel above a floor, said trolley having a turntable, drive means for rotating said turntable, and a power winch on said turntable; a rigid mast assembly mounted on said turntable and extending downwardly therefrom, said rigid mast assembly including a rigid mast and an intermediate mast slidably mounted on said rigid mast, each of said masts comprising two downwardly extending and spaced apart parallel mast members terminating in free ends above the floor, each of said masts including rigidifying brace means connected between its mast members, each mast member having a vertically extending guideway along its inner side, the guideways in each mast facing one another, counterweight means connected between said masts; a load carriage located between and vertically movably mounted on said guideways of said intermediate mast and being rigidly and vertically positioned therealong; cable means connected between said power winch carried by said trolley and connected with said carriage to raise and lower said load carriage relative to said intermediate mast and said intermediate mast relative to said rigid mast; stop means to limit relative travel between said masts and between said intermediate mast and said load carriage; and clamping means carried by said load carriage and including: a gear segment assembly pivotably mounted for rotation about a horizontal pivot axis on said load carriage, said gear segment assembly including a pair of gear segments each having a series of teeth on its arcuate periphery, said gear segment assembly also including a fixed jaw member rigidly and fixedly mounted thereon between said pair of gear segments, said clamping means also including a ram member extending from and generally normal to said fixed jaw member, a movable jaw slidably mounted on and along said ram member for movement toward and away from said fixed jaw member for cooperative gripping engagement therewith, and power means carried by said gear segment assembly and located between said pair of gear segments for moving said movable jaw relative to said fixed jaw whereby said jaws can grip a load; and power means carried by said load carriage including a driven pinion meshing with said teeth on said gear segments for rotating said clamping means about said pivot axis for swinging the load carried thereby about an arcuate path of about 90 degrees.

2. A crane set forth in claim 1 further characterized in that said power means carried by said gear segment assembly includes an electric motor, an elongated threaded shaft rotatably mounted on said ram member, sprocket and chain connection means between said electric motor and said elongated threaded shaft for rotating the latter selectively in either direction, said movable jaw having an internally threaded member carried thereby and in threaded engagement with said elongated threaded shaft, whereby as the latter rotates, said movable jaw moves relative to said fixed jaw member.

3. The crane set forth in claim 1 or 2, further characterized in that said fixed jaw member has a fixed gripping surface; said movable jaw has a pad slideably mounted thereon at an inclined angle to the fixed gripping surface of said fixed jaw member whereby when a load is engaged between said jaws and is hangingly suspended under the influence of gravity, said pad will shift relative to said movable jaw and toward said fixed gripping surface to cause a tight wedging engagement of said load therebetween.

4. The crane set forth in claim 3, wherein the load-gripping face of said pad engages the coil at a minimum of two points.

5. The crane set forth in claim 3, wherein said fixed gripping surface is convex.

6. The crane set forth in claim 4, wherein said fixed gripping surface is convex.

* * * * *